US006147458A

United States Patent [19]

Bucks et al.

[11] Patent Number: 6,147,458

[45] Date of Patent: Nov. 14, 2000

[54] CIRCUIT ARRANGEMENT AND SIGNALLING LIGHT PROVIDED WITH THE CIRCUIT ARRANGEMENT

[75] Inventors: Marcel J. M. Bucks; Engbert B. G. Nijhof, both of Best; Johannes E. Algra, Oss; John E. K. G. De Clercq, Oordegem; Pieter W. Habing; Stefan E. Roijers, both of Eindhoven, all of Netherlands

[73] Assignees: U.S. Philips Corporation, New York, N.Y.; Lumileds Lighting B.V., Best, Netherlands

[21] Appl. No.: 09/342,828

[22] Filed: Jun. 29, 1999

[30] Foreign Application Priority Data

Jul. 1, 1998 [EP] European Pat. Off. ..... 98202215

[51] Int. Cl.[7] ..... H05B 37/02

[52] U.S. Cl. ..... 315/225; 315/307; 315/DIG. 7

[58] Field of Search ..... 315/169.3, 74, 315/225, 224, 291, 194, DIG. 7, 307; 307/116

[56] References Cited

U.S. PATENT DOCUMENTS

| | | | |
|---|---|---|---|
| 5,646,484 | 7/1997 | Sharma et al. | 315/74 |
| 5,661,645 | 8/1997 | Hochstein | 363/89 |
| 5,719,450 | 2/1998 | Vora | 307/116 |

*Primary Examiner*—David Vu
*Assistant Examiner*—Chuc D. Tran
*Attorney, Agent, or Firm*—Bernard Franzblau

[57] ABSTRACT

A circuit arrangement for operating a semiconductor light source includes connection terminals for connecting a control unit, an input filter, a converter comprising a control circuit, output terminals for connecting the semiconductor light source, an apparatus CM for removing a leakage current occurring in the control unit in the non-conducting state, and a self-regulating circuit for deactivating the apparatus CM. The circuit arrangement is also provided with a detection circuit for detecting an incorrect functioning of the converter or the semiconductor light source. For this purpose, preferably a minimum voltage and a maximum voltage are detected at the output terminals.

21 Claims, 2 Drawing Sheets

CIRCUIT ARRANGEMENT AND SIGNALLING LIGHT PROVIDED WITH THE CIRCUIT ARRANGEMENT

BACKGROUND OF THE INVENTION

This invention relates to a circuit arrangement for operating a semiconductor light source comprising connection terminals for connecting a control unit, input filter means, a converter having a control circuit, output terminals for connecting the semiconductor light source, means CM for removing a leakage current occurring in the control unit in the non-conducting state, which means include a controlled semiconductor element, and self-regulating deactivating means for deactivating the means CM.

The invention also relates to a signalling light provided with such a circuit arrangement.

A circuit arrangement of the type mentioned in the opening paragraph is described in U.S. Pat. No. 5,661,645. Semiconductor light sources are increasingly used as signalling lights. In such an application, a semiconductor light source has an advantage with respect to the usual incandescent lamp in that it has a much longer service life and a considerably lower power consumption than an incandescent lamp. Signalling lights often form a part of a complex signalling system, for example, a traffic control system with traffic lights. If the above advantages of semiconductor light sources are to be effected on a wide scale, it is necessary for the circuit arrangement to provide retrofit possibilities with respect to existing signalling systems.

A signalling light in an existing signalling system is often controlled by means of a solid-state relay, a status test of the relay and of the signalling light taking place at the connection terminals of the connected circuit arrangement. It is a general property of solid-state relays that a leakage current occurs in the non-conducting state of the relay. To preclude an incorrect outcome of the status test during operation of a semiconductor light source, use is made of the means CM which ensure that, in the non-conducting state of the control unit, for example a solid-state relay, a leakage current occurring in the control unit is removed and that the voltage at the connection terminals of the circuit arrangement remains below a level necessary for obtaining a correct outcome of the status test. It is thus achieved, in a simple and effective manner, that the circuit arrangement exhibits a characteristic at its connection terminals which corresponds substantially to the characteristic of an incandescent lamp. In this respect, an important feature of an incandescent lamp characteristic is the comparatively low impedance of the lamp in the extinguished state, so that the removal of the leakage current through the incandescent lamp leads only to a low voltage at the connection terminals of the control unit. The means CM include, in the circuit arrangement described herein, deactivating means for deactivating the means CM when the control unit is in the conducting state, corresponding to the switched-on converter, which has the advantage that unnecessary power dissipation is counteracted. The functioning of the deactivating means is voltage-dependent and self-regulating.

The known circuit arrangement does not include a provision enabling the control unit to receive a signal under conditions corresponding to a defective incandescent lamp. This constitutes a problem for the application of the circuit arrangement and the semiconductor light source provided with said circuit arrangement.

SUMMARY OF THE INVENTION

It is an object of the invention to provide a measure by means of which the above problem can be overcome either completely or partly.

In accordance with the invention, this object is achieved in that the circuit arrangement is provided with detection means for detecting an incorrect functioning of the converter or of the semiconductor light source connected thereto. In the case of an incorrect functioning of the converter or the end of the service life of one or more elements of the semiconductor light source, the invention enables the circuit arrangement to exhibit a characteristic at its connection terminals which corresponds to that of a defect incandescent lamp. Preferably, the detection means form part of the self-regulating deactivating means. This has the advantage that the circuit arrangement may be of a relatively simple construction.

Preferably, the means CM are provided with a cutout element. This enables the means CM to be deactivated, while the converter is switched on, by rendering the controlled semiconductor element non-conductive, thereby counteracting unnecessary power dissipation, while deactivation as a result of detection of an incorrectly functioning converter or semiconductor light source takes place by activating the cutout element. Advantageously, the cutout element and the semiconductor element are arranged in series, and the cutout element is activated when the controlled semiconductor element of the means CM are in the conductive state. In this manner, a division is made between a protection function and a non-protection function of the deactivation of the means CM, which fits the state of the means CM when the control unit is non-conducting, i.e. switched-off converter. In an advantageous embodiment of the circuit arrangement in accordance with the invention, the detection means can suitably be used, provided the converter functions correctly, for generating a control signal $S_L$ for deactivating the means CM by rendering the controlled semiconductor element non-conductive. In this manner, it is advantageously achieved that, in case the converter functions incorrectly, i.e. in the absence of the control signal $S_L$, the controlled semiconductor element of the means CM becomes conductive. Deactivation of the means CM subsequently takes place by activating the cutout element and results in a very high impedance at the connection terminals. For the control unit, the presence of a very high impedance at the connection terminals corresponds to an indication that an incandescent lamp is defective. In a further advantageous embodiment of the circuit arrangement in accordance with the invention, the detection means can suitably be used, in case the connected semiconductor light source functions incorrectly, to generate a control signal $S_H$ for rendering the semiconductor element conductive. For the sake of simplicity, this preferably takes place by eliminating the control signal $S_L$. Also under these conditions, deactivation of the means CM subsequently takes place by activating the cutout element. By detecting a minimum voltage at the output terminals, it can be readily detected whether the converter functions improperly. In this connection, the detection means for detecting the minimum voltage preferably serve to generate the control signal $S_L$. On the other hand, the detection of a maximum voltage at the output terminals makes it possible to determine whether the semiconductor light source is completely or partly defective. The detection means for detecting the maximum voltage preferably serve to generate the control signal $S_H$.

In a further improved embodiment of the circuit arrangement in accordance with the invention, the detection means for detecting a maximum voltage can also be used to generate a control signal $S_O$ for activating the converter. In this manner, it is advantageously ensured that the controlled semiconductor element of the means CM remains conductive until the cutout element deactivates the means CM.

In an advantageous embodiment of the circuit arrangement in accordance with the invention, the circuit arrangement is provided with a stabilized low-voltage supply, and the means CM in the activated state constitute a supply source for the stabilized low-voltage supply. This embodiment has the major advantage that the stabilized low-voltage supply delivers the required low voltage very rapidly upon switching-on the converter by turning on the control unit, for example, the solid-state relay, because the means CM have already been activated.

In the present description and claims, the term "converter" is to be understood to mean an electrical circuit by means of which an electrical power supplied by the control unit is converted into a current-voltage combination required for operating the semiconductor light source. Preferably, a switch mode power supply provided with one or more semiconductor switches is used for this purpose. Since modern switch mode power supplies often are DC-DC converters, it is preferable for the input filter means to be also provided with rectifier means which are known per se.

Preferably, a signalling light provided with a housing including a semiconductor light source according to the invention is also provided with the circuit arrangement in accordance with the invention. The possibilities of using the signalling light as a retrofit unit for an existing signalling light are substantially increased thereby. The application range as a retrofit signalling light is optimized if the circuit arrangement is provided with a housing which is integrated with the housing of the signalling light.

These and other aspects of the invention will be apparent from and elucidated with reference to the embodiments described hereinafter.

DESCRIPTION OF THE PREFERRED EMBODIMENTS

Figure 1:
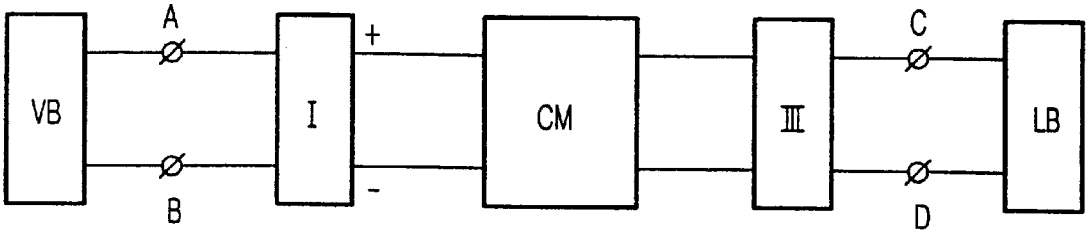
FIG. 1 diagrammatically shows the circuit arrangement.

In FIG. 1, A and B are connection terminals for connecting a control unit VB, for example provided with a solid-state relay. Reference I denotes input filter means and reference III denotes a converter with a control circuit. C, D are output terminals for connecting the semiconductor light source LB. Means CM for removing a leakage current occurring in the control unit in the non-conducting state are referenced CM. The input filter means I are provided with a positive pole+ and a negative pole−.

Figure 2:
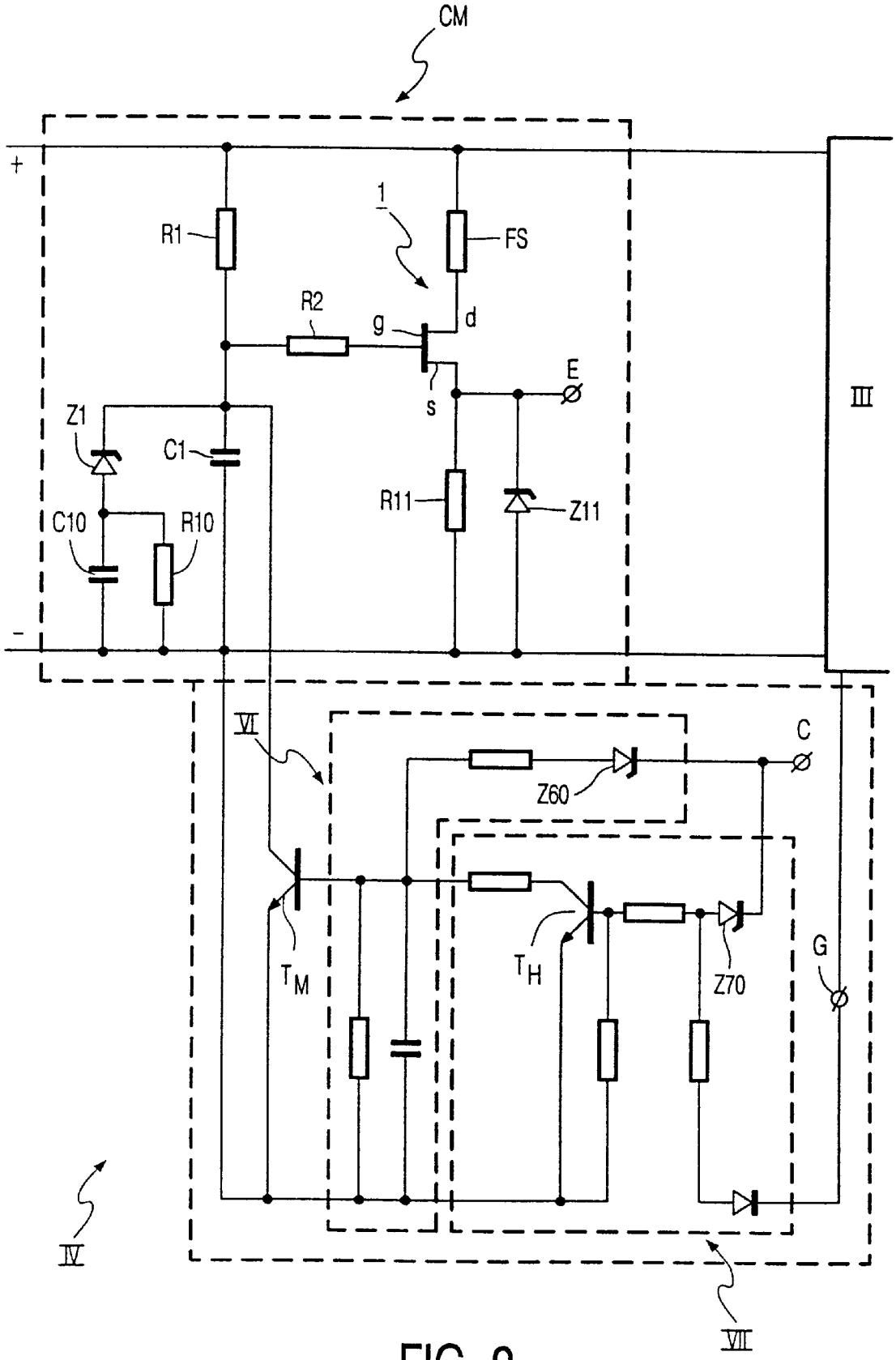
FIG. 2 shows a diagram of the means CM in greater detail.

The means CM, of which the diagram is shown in more detail in FIG. 2, comprise a MOSFET 1 as the controlled semiconductor element, having a gate g, a drain d and a source s. Said MOSFET 1 is arranged in series with a cutout element FS. The gate g of the MOSFET 1 is connected via a resistor R2 to a voltage divider circuit which is connected electrically in parallel to the input filter means I, which comprise a series arrangement of a resistor R1 and a capacitor C1. The capacitor C1 is shunted by a network comprising a zener diode Z1, a capacitor C10 and a resistor R10. The source s of MOSFET 1 is connected, by means of a parallel circuit of a resistor R11 and a zener diode Z11 to the negative pole− of the input filter means I. Reference E denotes a connection point of the means CM for connection to a stabilized low-voltage supply which forms part of the circuit arrangement. The means CM in the activated state form, through the connection point E, a supply source for the stabilized low-voltage supply.

FIG. 2 also shows deactivating means IV, which are included in the circuit arrangement and which serve to deactivate the means CM. For this purpose, a switch $T_M$ is connected, on the one hand, to a common junction point of resistor R1 and capacitor C1 and, on the other hand, to the negative pole−. A control electrode of the switch $T_M$ is connected to the output terminal C by means of a voltage-detection network. Said voltage-detection network includes detection means VI for detecting a minimum voltage and detection means VII for detecting a maximum voltage. The detection means VI comprise a zener diode Z60 which is arranged in series with a voltage-dividing network for rendering conductive the switch $T_M$ at a voltage at the output terminal C which is higher than the minimum voltage. As a result, the switch $T_M$ generates a control signal $S_L$ which deactivates the means CM by rendering the controlled semiconductor element 1 non-conductive. The detection means VII include a zener diode Z70 for detecting a maximum voltage at the output terminal C. By means of a resistance network, the zener diode Z70 is connected to a control electrode and to an emitter of a switch $T_H$. A collector of the switch $T_H$ is connected to the control electrode of switch $T_M$. At a voltage on the output terminal C above the maximum voltage, the switch $T_H$ is rendered conductive, so that the switch $T_H$ generates a control signal $S_H$ for eliminating the control signal $S_L$. The zener diode Z70 is also connected to the control circuit of the converter III, by means of a resistance-diode network via a connection point G. As a result, upon detection of the maximum voltage, a control signal $S_O$ is generated in the detection means VII to activate the converter III. Preferably, the converter is activated, by means of the control signal $S_O$, at a power which is so low that the voltage at the output terminal is permanently higher than the maximum voltage.

When the control unit VB is switched on, i.e. when the converter III is switched on, the voltage at the output terminal C increases, whereupon the zener diode Z60 becomes conductive when it reaches a zener voltage which is chosen so as to be equal to the minimum voltage, and the switch $T_M$ becomes conductive, causing the MOSFET 1 to be rendered non-conductive. In this connection, inter alia, the voltage-dividing network for rendering the switch $T_M$ conductive is dimensioned so that power from the low-voltage supply V is taken over by, for example, the output of the converter III. If the converter functions improperly or in the case of a short-circuit in the connected semiconductor light source, the voltage at the output terminal C will not reach the threshold voltage of the zener diode Z1. Consequently, the MOSFET 1 remains conductive and, after some time, the cutout element FS will be activated, causing the means CM to be deactivated.

As long as the converter III and the semiconductor light source LB function correctly, the voltage at the output terminal C will be above the minimum voltage and below the maximum voltage. As a result, the MOSFET 1 will remain deactivated during this time interval, so that unnecessary power dissipation is counteracted. If the semiconductor light source LB breaks down, the voltage at the output terminal C increases. As soon as this voltage reaches the value of the zener voltage of zener diode Z70, the zener diode Z70 will become conductive. The zener voltage of zener diode Z70 is chosen to be equal to the maximum voltage. If zener diode Z70 becomes conductive, then, on the one hand, the activation of the converter III via connection point G continues, so that the voltage at the output terminal C stays equal to the maximum voltage and, on the other hand, the means CM are activated again, as the switch $T_M$ is rendered non-conductive by the fact that the switch $T_H$ becomes conductive, until the cutout element FS is activated and hence the means CM are deactivated. By combining the capacitor C10 and the zener diode Z11, it is advantageously achieved that, when the means CM are permanently in the active state, an increasing current flows through the cutout element FS, so that the cutout element will be reliably activated.

Although the means for deactivating the means CM are indicated as separate means IV in the drawing, they preferably form part of the control circuit of the converter III.

Figure 3:
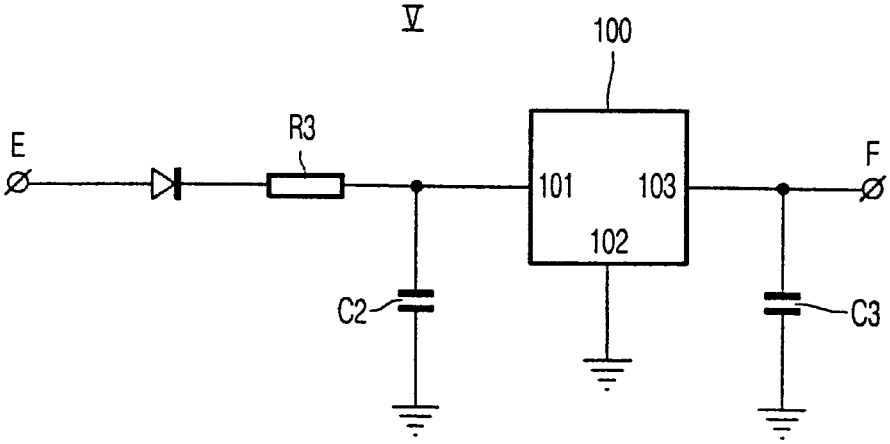
FIG. 3 is a diagram of a stabilized low-voltage supply.

FIG. 3 shows a stabilized low-voltage supply V which forms part of the circuit arrangement. The stabilized low-voltage supply V is connected with an input to connection point E of the means CM, which thus forms, when in the active state, a supply source for the stabilized low-voltage supply. The connection point E is connected to a pin 101 of an integrated circuit (IC) 100 via a diode D1 and a network of a resistor R3 and a capacitor C2. A pin 103 of the IC 100 forms an output pin carrying a stabilized low-voltage which can be taken off by means of connector F. The pin 103 is connected to ground via a capacitor C3. A pin 102 of the IC 100 is also connected to ground.

In a practical realization of the embodiment of the circuit arrangement according to the invention as described above, this circuit arrangement is suitable for connection to a control unit which supplies a voltage in the conductive state of at least 80 V, 60 Hz and at most 135 V, 60 Hz, and which is suitable for operating a semiconductor light source comprising a matrix of 3*6 LEDs, make Hewlett-Packard, with a forward voltage $V_F$ of between 2 V and 3 V, defined at 250 mA and an ambient temperature of 25° C. A rectified voltage with an effective value of at least 80 V and at most 135 V is present at the positive pole+ of the input filter means when the converter is in the active state. The MOSFET 1 of the means CM is of the STP3NA100F1 type (make ST). The zener diode Z1 has a zener voltage of 15 V, the zener diode Z11 of 15 V. The capacitor C1 has a value of 220 pF, the capacitor C10 has a value of 1 $\mu$F, and the resistors R1, R2, R10 and R11 have values of 680 kOhm, 10 kOhm, 100 kΩ and 330 Ohm, respectively. When the control unit is disconnected, this results in a maximum current through the MOSFET 1 of 31 mA, which corresponds to a voltage at the input terminal A of at most 10 Vrms. This corresponds to the maximum permissible voltage level of the control unit in the disconnected state which will just lead to a correct outcome of a status test of the control unit.

The switch $T_M$ is of the BC547C type (make Philips), as is the switch $T_H$. The zener diode Z60 has a zener voltage of 6.2 V, and the zener diode Z70 has a zener voltage of 27 V. The cutout element FS is a fusistor with a value of 470 Ω. The IC 100 is of the 78L08 type (make National Semiconductors) and supplies a stabilized low voltage of 8 V with an accuracy of 5%. The resistor R3 has a value of 100 Ω, the capacitor C2 has a capacitance of 100 nF and C3 has a capacitance of 1 $\mu$F.

If, when the control unit is in the connected state, the voltage at the output terminal C remains below 6.2 V or increases to above 27 V, the MOSFET 1 will remain conductive or become conductive, respectively, so that the current flowing through the fusistor increases. In the embodiment described herein, this will cause the fusistor to be blown after at least 10 ms and at most 1 ms, leading to deactivation of both the means CM and the converter III.

The circuit arrangement provided with a housing forms part of a signalling light which is provided with a housing with a semiconductor light source, the housing of the circuit arrangement being integrated with the housing of the signalling light. The embodiment described herein is highly suitable for use as a traffic light in a traffic control system.

What is claimed is:

1. A circuit arrangement for operating a semiconductor light source comprising:

connection terminals for connecting a control unit, input filter means, a converter having a control circuit, output terminals for connecting the semiconductor light source, means CM for removing a leakage current occurring in the control unit in the non-conducting state, which means include a controlled semiconductor element, and self-regulating deactivating means for deactivating the means CM, wherein the circuit arrangement is provided with detection means for detecting an incorrect functioning of the converter or of the semiconductor light source connected thereto.

2. A circuit arrangement as claimed in claim 1, wherein the detection means form part of the self-regulating deactivating means.

3. A circuit arrangement as claimed in claim 1, wherein the means CM are provided with a cutout element.

4. A circuit arrangement as claimed in claim 3, wherein the cutout element and the controlled semiconductor element are connected in series.

5. A circuit arrangement as claimed in claim 1, characterized in that when the converter functions correctly, the detection means generate a control signal SL for deactivating the means CM by rendering the controlled semiconductor element non-conductive.

6. A circuit arrangement as claimed in claim 1, characterized in that when the semiconductor light source functions incorrectly, the detection means generate a control signal $S_H$ for rendering the controlled semiconductor element conductive.

7. A circuit arrangement as claimed in claim 6, wherein the control signal $S_H$ serves to eliminate the control signal $S_L$.

8. A circuit arrangement as claimed in claim 1, wherein the detection means serve to detect a minimum voltage or a maximum voltage at the output terminals.

9. A circuit arrangement as claimed in claim 5, wherein the detection means detect the minimum voltage at the output terminals and is operative to generate the control signal SL.

10. A circuit arrangement as claimed in claim 6, wherein the detection means detect a maximum voltage at the output terminals and operates to generate the control signal SH.

11. A circuit arrangement as claimed in claim 8, wherein the detection means for detecting a maximum voltage also generate a control signal $S_O$ for activating the converter.

12. A circuit arrangement as claimed in claim 1, further comprising a stabilized low-voltage supply, and the means CM in the activated state constitute a supply source for the stabilized low-voltage supply.

13. A signalling light comprising: a housing including a semiconductor light source, and means coupling the circuit arrangement as claimed in claim 1 to the semiconductor light source.

14. A signalling light as claimed in claim 13, wherein the circuit arrangement has a housing which is integrated with the housing of the signalling light.

15. A circuit for operating a semiconductor light source comprising:

input terminals for connection to a control unit, an input filter coupled to the input terminals, a converter including a control circuit and having output terminals for connection to the semiconductor light source in order to energize the semiconductor light source, means CM including a controlled semiconductor element for removing a leakage current occurring in the control unit in the non-conducting state, said means CM having an input coupled to the input filter and an output coupled to the converter, self-regulating deactivating means for deactivating the means CM when the control unit is in a conductive state, and detection means for detecting a defective converter or semiconductor light source connected thereto.

16. An operating circuit as claimed in claim 15 wherein the means CM include a cutout element activated if the converter operates incorrectly.

17. An operating circuit as claimed in claim 15 wherein the detection means, in response to correct operation of the converter, generates a control signal which deactivates the means CM by driving the controlled semiconductor element into a non-conductive state.

18. An operating circuit as claimed in claim 15 wherein the detection means detect a minimum voltage and a maximum voltage at the converter output terminals and the deactivating means are operative to deactivate the means CM by driving the controlled semiconductor element into a non-conductive state so long as the voltage at the converter output terminals are within a voltage window defined by said minimum voltage and said maximum voltage.

19. An operating circuit as claimed in claim 15 wherein, if the semiconductor light source operates incorrectly, the detection means generate a control signal that makes the controlled semiconductor element conductive.

20. An operating circuit as claimed in claim 15 wherein the detection means supply a control signal to the control circuit of the converter so as to effect the operation of the converter.

21. An operating circuit as claimed in claim 15 wherein the semiconductor light source comprises one or more light emitting diodes and the converter includes a switching transistor.

* * * * *